US007150253B2

(12) United States Patent
Itou et al.

(10) Patent No.: US 7,150,253 B2
(45) Date of Patent: Dec. 19, 2006

(54) ENGINE START CONTROL SYSTEM AND ENGINE START CONTROL METHOD

(75) Inventors: Takayasu Itou, Fujisawa (JP); Junsuke Ino, Yamato (JP)

(73) Assignee: Nissan Motor Co., Ltd., Kanagawa-Ken (JP)

( * ) Notice: Subject to any disclaimer, the term of this patent is extended or adjusted under 35 U.S.C. 154(b) by 0 days.

(21) Appl. No.: 11/014,946

(22) Filed: Dec. 20, 2004

(65) Prior Publication Data

US 2005/0132994 A1 Jun. 23, 2005

(30) Foreign Application Priority Data

Dec. 22, 2003 (JP) ..... P 2003-425032

(51) Int. Cl.
*F02N 17/00* (2006.01)

(52) U.S. Cl. ..... 123/179.3; 123/198 D; 290/38 E

(58) Field of Classification Search ..... 123/179.3, 123/179.4, 198 D; 290/38 R, 38 E
See application file for complete search history.

(56) References Cited

U.S. PATENT DOCUMENTS 4,490,620 A * 12/1984 Hansen ..... 290/38 R
5,182,943 A * 2/1993 Fukui et al. ..... 73/116
5,349,931 A * 9/1994 Gottlieb et al. ..... 123/179.2
5,601,058 A * 2/1997 Dyches et al. ..... 123/179.2
5,831,804 A 11/1998 Vilou
5,977,647 A * 11/1999 Lenz et al. ..... 290/40 C
6,003,484 A 12/1999 Vilou
6,024,065 A * 2/2000 Hojna et al. ..... 123/179.3
6,353,306 B1 * 3/2002 Mixon ..... 320/160
6,481,404 B1 * 11/2002 Perry et al. ..... 123/179.3
6,515,456 B1 * 2/2003 Mixon ..... 320/160
6,799,546 B1 * 10/2004 Gonring et al. ..... 123/179.3
6,800,952 B1 * 10/2004 Blackburn et al. ..... 290/36 R
2002/0008494 A1 * 1/2002 Nagao et al. ..... 318/778
2002/0038643 A1 4/2002 Sumitomo et al.
2002/0185098 A1 * 12/2002 Perry et al. ..... 123/179.3
2002/0185099 A1 * 12/2002 Ogawa et al. ..... 123/179.3

FOREIGN PATENT DOCUMENTS

EP 1 197 653 A2 10/2001
JP 05-96468 12/1993
JP 2000-045920 2/2000
JP 2002-187505 7/2002
JP 2002-221131 8/2002
JP 2002-221132 8/2002
JP 2003-254210 9/2003

* cited by examiner

*Primary Examiner*—Stephen K. Cronin
*Assistant Examiner*—Arnold Castro
(74) *Attorney, Agent, or Firm*—McDermott Will & Emery LLP

(57) ABSTRACT

An engine start control system which includes: a switch for turning on/off power supply to a starter of an engine; a sensor for sensing a crank angle of the engine; an engine status judgment unit which determines whether or not the engine is in a cranking state based on the crank angle sensed by the sensor; and a switch controller by which the switch is controlled to turn off the power supply to the starter, if a predetermined time elapses without the engine status judgment unit judging that the engine is in the cranking state, after the switch has been controlled to turn on the power supply to the starter.

5 Claims, 10 Drawing Sheets

FIG.2

| | POWER DISTRIBUTION MODE | OFF | ACC | IGN | STARTER | IGN | ACC | OFF |
|---|---|---|---|---|---|---|---|---|
| LOAD SWITCHING ELEMENTS | ACC | OFF | ON | ON | OFF | ON | ON | OFF |
| | IGN | OFF | OFF | ON | ON | ON | OFF | OFF |
| | STARTER | OFF | OFF | OFF | ON | OFF | OFF | OFF |

ENGINE START CONTROL SYSTEM AND ENGINE START CONTROL METHOD

BACKGROUND OF THE INVENTION

1. Field of Invention

The present invention relates to control system and control method for starting an engine of a vehicle or the like, particularly to control of power supply to a starter motor in case of starter motor failure.

2. Description of Related Art

In recent years, with regard to vehicles including automobiles, increase in operability is required in addition to improvement in basic performance and safety thereof. Smart ignition is a function of improving operability.

The smart ignition is a function of starting an engine without using a mechanical key by a driver. A key held by the driver is a device which wirelessly communicates with a device mounted on a vehicle. For example, ID or the like is transmitted and checked between the key and the on-vehicle device, thereby confirming whether or not the key is a proper key. Then, the driver holding the proper key operates an operation unit, such as a switch or the like, provided in the vehicle, whereby the engine is started.

In a typical engine starter, first, two coils of a pull-in coil and a holding coil are energized before the rotation of a starter motor is begun. When a current passes through the pull-in coil and a magnet switch is turned on, a battery and the starter motor are connected. Further, a pinion moves, and a pinion gear of the starter motor and a ring gear of a flywheel of the engine are engaged, whereby the rotation of the starter motor can be transferred to the engine.

When a current is directly supplied from the battery to the starter motor and the starter motor begins to rotate, a crankshaft of the engine begins to rotate.

The rotational speed of the crankshaft of the engine is low shortly after the crankshaft begins to rotate. This state is referred to as a cranking state. In order to reliably start the engine, the cranking state needs to be maintained as long as possible.

In the realization of the smart ignition, the switching of the electric connection between the battery and each of various power loads, which has been performed by an operation of turning a mechanical key by the driver, needs to be performed using an electronic element, such as a relay, a semiconductor switch, or the like. That is, it is necessary to connect or disconnect the battery to/from an accessory (ACC) load, an ignition (IGN) load, the starter motor, or the like using an electronic element.

In the case where the switching among loads is performed using electronic elements, it is important to appropriately control switching timing. In particular, in the case where the engine is started by use of the aforementioned starter, the capability of starting the engine is reduced if the time for which the starter motor is being activated is short. Meanwhile, if the activation time is long, the starter motor may be overloaded. Accordingly, the time for which the starter motor is being activated needs to be appropriately controlled.

Various proposals have been made in order to perform power supply to the starter motor for an appropriate time. Japanese Patent Application Laid-open Publication No. 2002-221131 discloses a method of controlling the switching timing of a power source by determining ease in starting an engine based on the number of operations. Moreover, Japanese Patent Application Laid-open Publication No. 2002-221132 discloses a method of switching a power source by estimating an intention of a driver based on the operation of an operation unit by the driver.

SUMMARY OF THE INVENTION

In a device/system equipped with the aforementioned smart ignition, power supply to loads is not appropriately controlled in the case where a failure has occurred in electronic elements.

For example, in the case where a contact failure of the magnet switch has occurred in the aforementioned starter, the battery and the motor are not connected, and power continues to be supplied from the battery to the pull-in coil and the holding coil.

Electronic elements used in the starter and the peripheral circuits thereof should have large rated currents so as to allow large currents for a certain time even in such a situation. This increases cost and requires a large-scale system configuration.

The present invention has been accomplished in light of the above-described problems. An object of the present invention is to provide an engine start control system and an engine start control method in which power supply to a starter motor is properly controlled, allowing smaller capacity and low rating elements to be adopted, thus providing a low-cost system with a simplified configuration.

An aspect of the present invention is an engine start control system comprising: a switch for turning on/off power supply to a starter of an engine; a sensor for sensing a crank angle of the engine; an engine status judgment unit which determines whether or not the engine is in a cranking state based on the crank angle sensed by the sensor; and a switch controller by which the switch is controlled to turn off the power supply to the starter, if a predetermined time elapses without the engine status judgment unit judging that the engine is in the cranking state, after the switch has been controlled to turn on the power supply to the starter.

BRIEF DESCRIPTION OF THE DRAWINGS

The invention will now be described with reference to the accompanying drawings wherein:

FIG. 2 is a table showing load connection states (switching of switching elements of a load switching unit) in various power distribution modes and the transition (switching order) of the power distribution mode.

DETAILED DESCRIPTION OF THE PREFERRED EMBODIMENT

First Embodiment

An engine start control system of a first embodiment of the present invention will be described with reference to FIGS. 1 to 6D.

Figure 1:
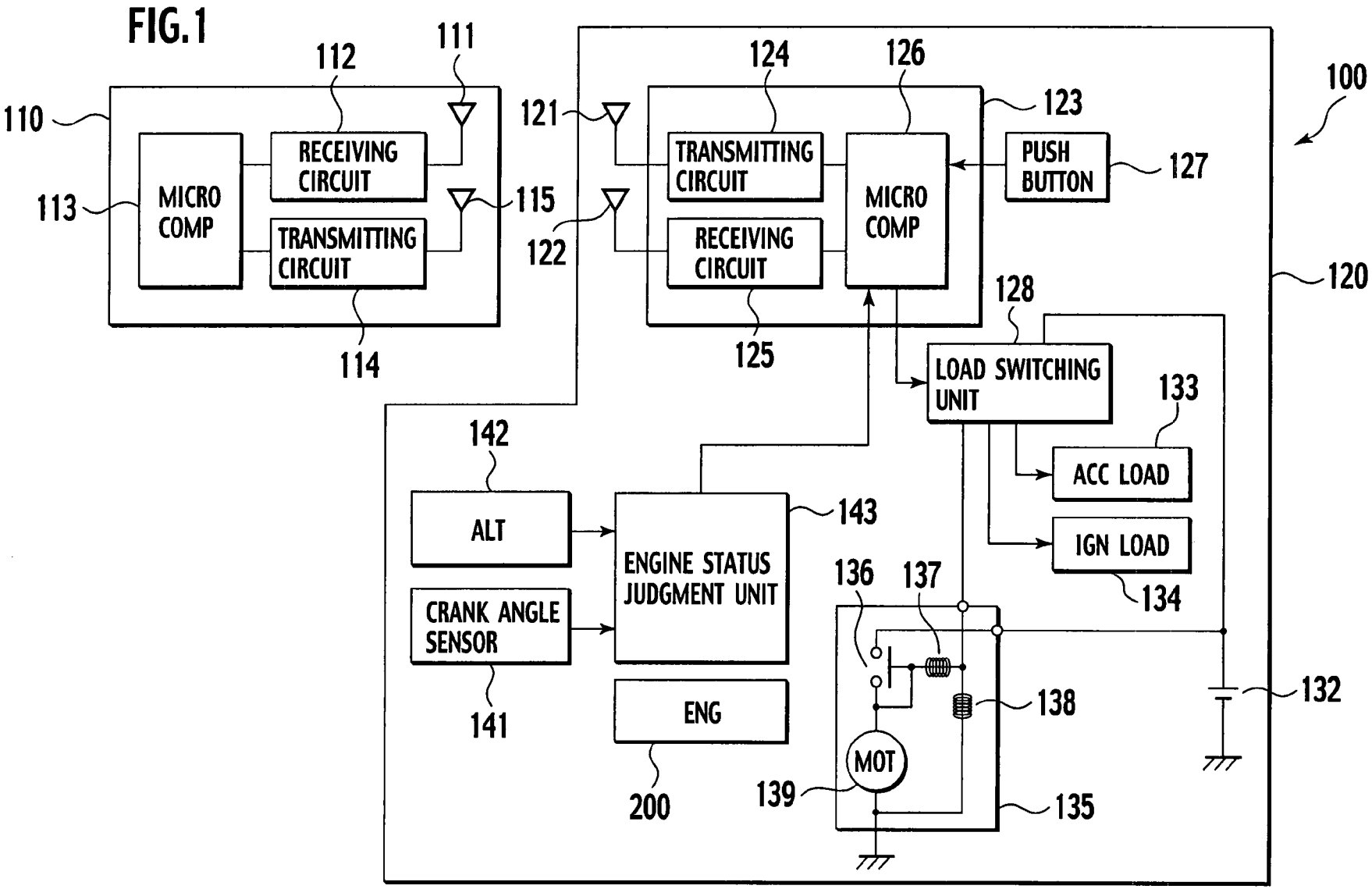
FIG. 1 is a block diagram showing the configuration of an engine start control system according to a first embodiment of the present invention.

As shown in FIG. 1, an engine start control system 100 of the present embodiment has a mobile device 110 and an on-vehicle device 120.

The mobile device 110 is a small device which is held by a driver, such as an owner or the like of a vehicle, and which has a function as a key that allows the vehicle to be operated. Information (ID information) for identifying the mobile device is set in the mobile device 110 in advance, and the mobile device 110 transmits the information to the on-vehicle device 120 by performing wireless communications with the on-vehicle device 120. The transmitted ID information is checked in the on-vehicle device 120, thus determining whether or not the mobile device 110 is a proper key corresponding to the vehicle, i.e., whether or not the holder of the mobile device 110 is a proper user of the vehicle.

The on-vehicle device 120 communicates with the mobile device 110 to obtain the ID information set in the mobile device 110, and determines whether or not the driver is a proper driver. Further, the on-vehicle device 120 controls the start of an engine based on instructions from the driver through a switch (push button 127), to be described later, which is provided at the driver seat of the vehicle.

Hereinafter, detailed configurations of the mobile device 110 and the on-vehicle device 120 will be described.

The mobile device 110 has a receiving antenna 111, a receiving circuit 112, a microcomputer 113, a transmitting circuit 114, and a transmitting antenna 115.

The receiving antenna 111 receives a signal of, for example, an ID request or the like, which is transmitted from the on-vehicle device 120.

The receiving circuit 112 performs processes of demodulation, decoding, and the like on the signal received by the receiving antenna 111, and outputs the generated signal to the microcomputer 113.

The microcomputer 113 performs a predetermined process on the signal inputted from the receiving circuit 112, generates return data as needed, and outputs the return data to the transmitting circuit 114. For example, when an ID request signal has been transmitted from the on-vehicle device 120 and the signal has been inputted into the microcomputer 113 through the receiving antenna 111 and the receiving circuit 112, the microcomputer 113 reads the ID information of the mobile device 110 itself which has been stored therein in advance, performs processes of encoding and the like as needed, and outputs the processed ID information to the transmitting circuit 114 in order to reply to the on-vehicle device 120.

It is noted that the ID information is set in, for example, memory (not shown) in the microcomputer 113 in advance.

Moreover, in the case where the signal, such as an ID request signal or the like, which has been transmitted from the on-vehicle device 120 is a signal on which an encoding process has been performed, the microcomputer 113 first decodes this signal, and then performs a predetermined process in accordance with the signal.

The transmitting circuit 114 converts the return data, for example, ID information or the like, which is inputted from the microcomputer 113, into a transmittable signal by performing processes of transmission channel encoding, modulation, and the like, and outputs the resultant signal to the transmitting antenna 115 in order to transmit the resultant signal to the on-vehicle device 120.

The transmitting antenna 115 transmits the signal inputted from the transmitting circuit 114, to the on-vehicle device 120.

The on-vehicle device 120 has a transmitting antenna 121, a receiving antenna 122, a power distribution selector unit 123, a push button 127, a load switching unit 128, a battery 132, an ACC load 133, an IGN load 134, a starter 135, a crank angle sensor 141, an alternator 142, and an engine status judgment unit 143.

Moreover, the power distribution selector unit 123 has a transmitting circuit 124, a receiving circuit 125, and a microcomputer 126, and the starter 135 has a magnet switch 136, a pull-in coil 137, a holding coil 138, and a motor 139.

It is noted that the engine whose start is controlled by the engine start control system 100 is shown as an engine 200 in FIG. 1.

The transmitting antenna 121 transmits to the mobile device 110 a signal, for example, an ID request signal or the like, applied from the transmitting circuit 124 of the power distribution selector unit 123.

The receiving antenna 122 receives a signal containing, for example, the ID information transmitted from the mobile device 110, and outputs the received signal to the receiving circuit 125 of the power distribution selector unit 123.

The power distribution selector unit 123 controls the load switching unit 128 based on an operation of the push button 127 by the driver, the preceding power distribution mode, the status of the engine 200 which is detected in the engine status judgment unit 143, and the like.

Further, the power distribution selector unit 123 communicates with the mobile device 110 to obtain the ID information from the mobile device 110, and detects whether or not the mobile device 110 is an appropriate mobile device corresponding to the on-vehicle device 120, i.e., whether or not the driver holding this mobile device 110 is an appropriate driver.

The transmitting circuit 124 converts a signal of, for example, an ID request, which is inputted from the microcomputer 126, into a transmittable signal by performing predetermined processes of transmission channel encoding, modulation, and the like, and outputs the resultant signal to the transmitting antenna 121 in order to transmit the resultant signal to the mobile device 110.

The receiving circuit 125 performs processes of demodulation, decoding, and the like on a return signal or the like containing the ID information from the mobile device 110, which has been received by the receiving antenna 122, and outputs the generated signal to the microcomputer 126.

The microcomputer 126 controls the load switching unit 128 and changes the power distribution mode based on an operation of the push button 127, the preceding power distribution mode, the status of the engine 200 which is detected in the engine status judgment unit 143, and the like. Further, at this time, the microcomputer 126 obtains the ID information from the mobile device 110 as needed.

The power distribution mode is the connection state between the battery 132 and each load.

FIG. 2 shows load connection states (switching of switching elements of the load switching unit 128) in various power distribution modes and the transition (switching order) of the power distribution mode.

As shown in FIG. 2, the power distribution mode can be one of the following four modes: OFF mode in which no load is connected to the battery 132; ACC mode in which accessories (ACC load) are connected to the battery 132; IGN mode in which the accessories and an ignition system (IGN load) are connected to the battery 132; and STARTER mode in which the ignition system and the starter 135 are connected to the battery 132.

Further, the power distribution mode is begun with OFF mode in which the vehicle is not used, and shifts to ACC mode, IGN mode, STARTER mode, IGN mode, ACC mode, and OFF mode in principle every time the push button 127 is pushed.

In this situation, when a shift from OFF mode to ACC mode is to be made, the microcomputer 126 obtains the ID information of the mobile device 110 and determines whether or not the ID information indicates an ID corresponding to the on-vehicle device 120, in order to detect whether or not the vehicle is being operated by a proper driver.

Moreover, a shift from STARTER mode to IGN mode is made based not on the pushing of the push button 127 but on the operation status of the engine 200.

Specifically, first, in the case where the driver has pushed the push button 127 with the engine 200 stopped and the accessories not energized (OFF mode), the microcomputer 126 outputs an ID request signal to the mobile device 110 in order to detect whether or not the driver is an appropriate driver, i.e., in order to detect whether or not the mobile device 110 held by the driver is a mobile device corresponding to the on-vehicle device 120. Specifically, the microcomputer 126 performs processes of encoding and the like as needed to generate an ID request signal, and outputs the ID request signal to the transmitting circuit 124.

When the ID information has been returned from the mobile device 110 in response to the outputted ID request signal, the microcomputer 126 receives the ID information through the receiving antenna 122 and the receiving circuit 125 in the power distribution selector unit 123, and performs processes of decoding and the like as needed, thus obtaining the ID information of the mobile device 110. Then, the obtained ID information is checked against the previously stored ID information, thereby determining whether or not the driver is a proper driver, i.e., whether or not the mobile device 110 is a proper mobile device corresponding to the on-vehicle device 120.

It is noted that the ID information to be checked is assumed to be previously stored in, for example, memory (not shown) or the like in the microcomputer 126.

In the case where the driver has been judged not to be a proper driver as a result of checking the ID information, the microcomputer 126 does not perform processes relating to the control of the power distribution mode, and maintains the power distribution mode in OFF mode. That is, the microcomputer 126 maintains the state where the driver is not allowed to drive the vehicle, to start the engine, to use the accessories, and so on.

In this state, the aforementioned process of detecting whether or not the driver is proper, i.e., the process of generating an ID request signal and transmitting the ID request signal to the mobile device 110, is subsequently performed every time the push button 127 is operated.

In the case where the driver has been judged to be a proper driver as a result of checking the ID information, the microcomputer 126 outputs a switching signal to the load switching unit 128 so as to change the power distribution mode from OFF mode to ACC mode.

In the case where the power distribution mode has been shifted from OFF mode to ACC mode and then the push button 127 has been pushed, the microcomputer 126 outputs a switching signal to the load switching unit 128 so as to change the power distribution mode from ACC mode to IGN mode. The load switching unit 128 switches electric connection based on this signal, whereby the IGN load 134 is fed power and a ready state for engine start is created.

In the case where the power distribution mode has been shifted from ACC mode to IGN mode and then the push button 127 has been further pushed, the microcomputer 126 outputs a switching signal to the load switching unit 128 so as to change the power distribution mode from IGN mode to STARTER mode. Then, the battery 132 and the starter 135 are connected in the load switching unit 128, whereby the start of the engine 200 is begun.

A shift from STARTER mode to IGN mode is made based not on operation of the push button 127 but on a signal EC which indicates the status of the engine 200 and which is inputted from the engine status judgment unit 143 to be described later. Although details are to be described later, in the case where the engine 200 has been normally started, a signal ECN indicating that the engine 200 has entered a cranking state, and a signal ERN indicating that the engine 200 has begun to run normally, i.e. the crankshaft thereof has begun to rotate normally, are inputted in order from the engine status judgment unit 143. When the signal ERN indicating that the engine 200 has begun to run normally has been inputted from the engine status judgment unit 143, the microcomputer 126 outputs a switching signal to the load switching unit 128 so as to change the power distribution mode from STARTER mode to IGN mode. Thus, the connection between the battery 132 and the starter 135 is disconnected.

In the case where the push button 127 has been pushed when the engine 200 has been started and the power distribution mode is at IGN position, the microcomputer 126 outputs a switching signal to the load switching unit 128 so as to change the power distribution mode from IGN mode to ACC mode. The load switching unit 128 switches electric connection based on this signal, whereby powering the IGN load 134 is finished and the rotation of the engine 200 is stopped.

Further, in the case where the power distribution mode has been shifted from IGN mode to ACC mode and then the push button 127 has been further pushed, the microcomputer 126 outputs a switching signal to the load switching unit 128 so as to change the power distribution mode from ACC mode to OFF mode. The load switching unit 128 switches electric connection based on this signal, whereby power supply to substantially all the components of the vehicle is stopped and operation of the vehicle is finished.

In the case where the engine 200 has been normally started, the microcomputer 126 switches the power distribution mode as described above.

On the other hand, in the case where the engine 200 is not normally started in the situation in which the power distribution mode is in STARTER mode, i.e., in which the start operation of the engine 200 has been begun, the microcomputer 126 performs the process described below.

In the case where the signal ECN indicating that the engine 200 has entered a cranking state is not inputted from the engine status judgment unit 143, the microcomputer 126 waits for a predetermined time and then detects this situation (situation in which the engine 200 does not enter a cranking state). For example, in the case where the magnet switch 136 of the starter 135 has an abnormality, and in some other cases, the motor 139 is not driven and such a situation occurs.

Figure 3:
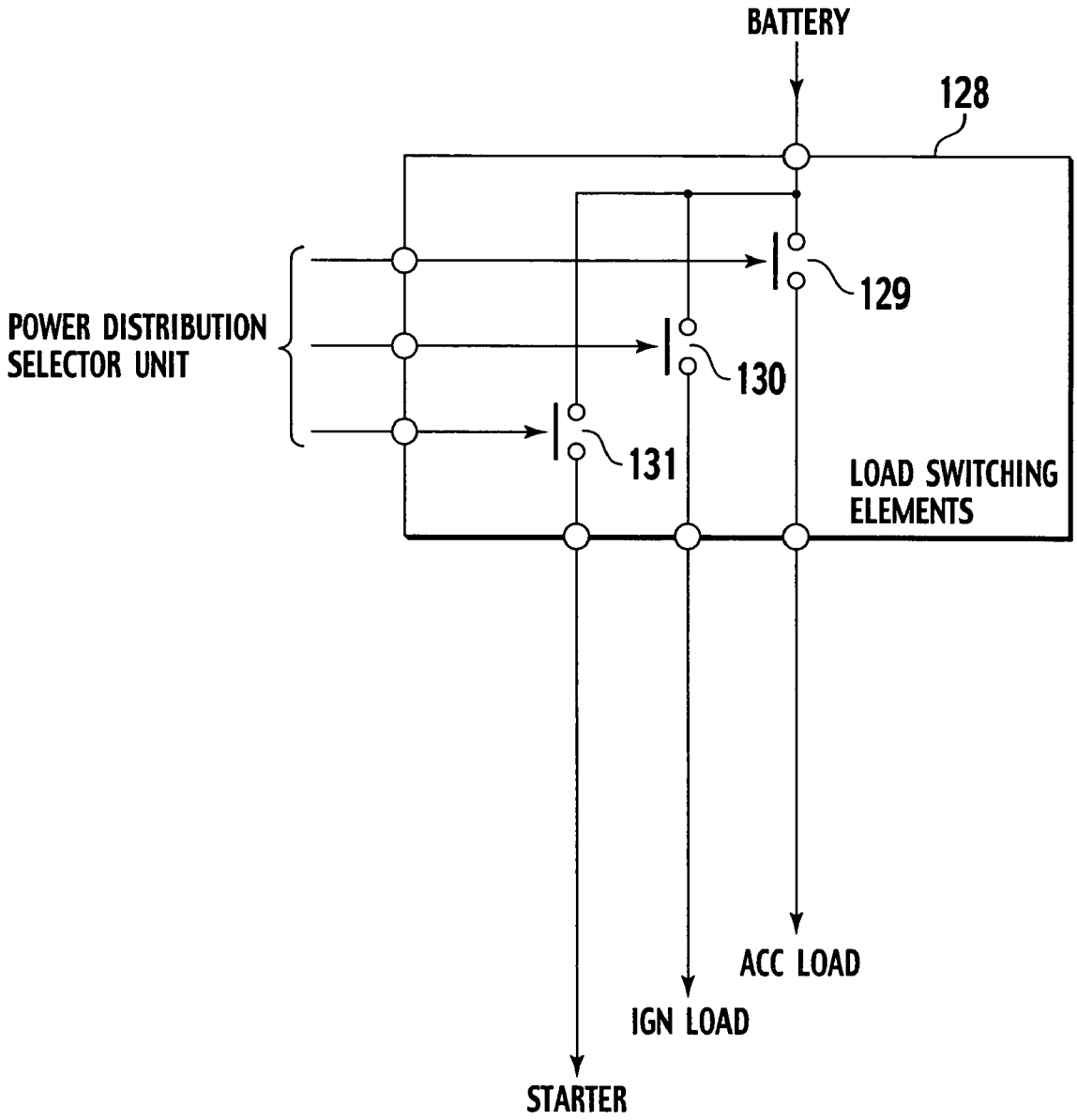
FIG. 3 is a diagram showing the configuration of the load switching unit shown in FIG. 1.

In the case where the above-described situation has been detected, the microcomputer 126 outputs a control signal to the load switching unit 128 so as to stop power feeding at least the starter 135, i.e., so as to turn off the starter-switching element 131 shown in FIG. 3. In the present embodiment, in addition to turning off the starter-switching element 131, an ACC-switching element 129 is turned on, thereby shifting the power distribution mode to IGN mode.

This results in an interruption of the power feeding to the starter 135 from the battery 132, and makes it possible to prevent a situation where the power feeding to the starter 135 in which an abnormality is considered to have occurred is continued and wastes power.

Moreover, in the case where the engine 200 has entered a cranking state but a signal indicating that the engine 200 has begun to run normally is not thereafter inputted, the microcomputer 126 waits for a predetermined time and then detects this situation (situation in which the crankshaft of the engine 200 does not begin to rotate normally). Subsequently, the microcomputer 126 outputs a control signal to the load switching unit 128 so as to stop power feeding to at least the starter 135, i.e., so as to turn off the starter-switching element 131 shown in FIG. 3. In the present embodiment, in addition to turning off the starter-switching element 131, the ACC-switching element 129 is turned on, thereby shifting the power distribution mode to IGN mode.

This results in an interruption of the power feeding to the starter 135 from the battery 132, and makes it possible to prevent a situation where the power is continued to be fed to the starter 135 and wasted under the condition that an abnormality have occurred in the engine 200 or the starter 135.

The microcomputer 126 of the power distribution selector unit 123 has the above-described functions.

The push button 127 is operated by the driver of the vehicle who issues instructions for the power feeding to the accessories and for the start and stop of the engine 200. A signal indicating that the push button 127 has been pushed is outputted to the microcomputer 126 of the power distribution selector unit 123. The driver simply pushes the push button 127 instead of turning an ignition switch using a key as heretofore.

The load switching unit 128 is means for switching a load connected to the battery 132 in accordance with instructions from the microcomputer 126 of the power distribution selector unit 123.

The configuration of the load switching unit 128 is shown in FIG. 3.

As shown in FIG. 3, the load switching unit 128 has the ACC-switching element 129, an IGN-switching element 130, and the starter-switching element 131.

The ACC-switching element 129 is a switch for switching between an ON state (connected state) and an OFF state (disconnected state) in the connection between the battery 132 and the ACC load 133. The IGN-switching element 130 is a switch for switching between ON and OFF states in the connection between the battery 132 and the IGN load 134. The starter-switching element 131 is a switch for switching between ON and OFF states in the connection between the battery 132 and the starter 135.

A control signal for switching each switching element between ON and OFF states is inputted from the microcomputer 126 of the power distribution selector unit 123 into the load switching unit 128 having the above-described configuration. Based on this control signal, the switching elements 129, 130, and 131 of the load switching unit 128 are sequentially switched between ON and OFF states. As a result, the power distribution mode transitions in order as shown in FIG. 2.

The battery 132 is a battery for supplying power to the ACC load 133, the IGN load 134, and the starter 135.

The ACC load 133 is the power load of so-called accessories, and a load which is supplied with power from the battery 132 when the power distribution mode is in ACC mode or IGN mode, as shown in FIG. 2.

The IGN load 134 is the power load of a so-called ignition system, and a load which is supplied with power from the battery 132 when the power distribution mode is in IGN mode or STARTER mode, as shown in FIG. 2.

The starter 135 is a device for starting the engine 200 using the battery 132 as a power source.

As shown in FIG. 1, the starter 135 has the magnet switch 136, the pull-in coil 137, the holding coil 138, and the motor 139. Further, the starter 135 has a pinion, a pinion gear, a ring gear, an overrunning clutch, and the like (not shown) as a mechanism for mechanically coupling the motor 139 and the engine 200.

When the starter-switching element 131 has been switched to an ON state in the load switching unit 128 and the battery 132 has been connected to the starter 135, the current from the battery 132 is supplied to the pull-in coil 137 and the holding coil 138.

Since a current flows through the pull-in coil 137, the magnet switch 136 is turned on, and the battery 132 and the motor 139 are directly coupled. Thereafter, a large current is supplied from the battery 132 to the motor 139, and therefore the motor 139 begins to rotate.

Moreover, for example, the pinion (not shown) is pushed out in the direction of the engine 200 by a magnetic force generated by the current flowing through the pull-in coil 137 and the holding coil 138, and the pinion gear engages the ring gear provided around a flywheel or somewhere, whereby the motor 139 and the engine 200 are mechanically coupled.

Thus, the rotation of the motor 139 is transferred to the engine 200, and the engine 200 is started.

It is noted that when the rotation of the motor 139 almost becomes excessive after the engine 200 has started, the overrunning clutch (not shown) is activated, thus preventing the overspeed of the motor 139.

Moreover, since the holding coil 138 is grounded, a current flows therein whenever the power distribution mode is in STARTER mode, and a constant magnetic force occurs therein. On the other hand, since the voltages at both ends of the pull-in coil 137 becomes the same potential after the magnet switch 136 has been turned on, the current flowing therethrough becomes zero. Accordingly, after the starter 135 has been activated, the current supplied through the load switching unit 128 flows only through the holding coil 138.

The crank angle sensor 141 is a sensor for sensing the rotation angle of a crankshaft (not shown). A signal CA indicating the crank angle sensed by the crank angle sensor 141 is inputted into an engine control unit (not shown), and used for controlling the ignition timing of the engine 200.

Figure 6A:
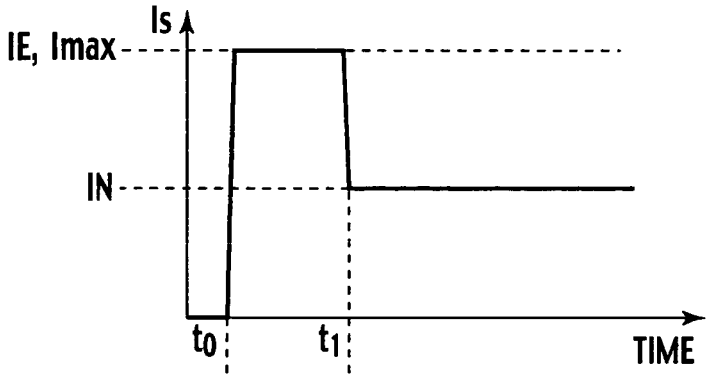
FIG. 6A shows time-dependent change in a current supplied to a starter motor when an engine is started.
Figure 6B:
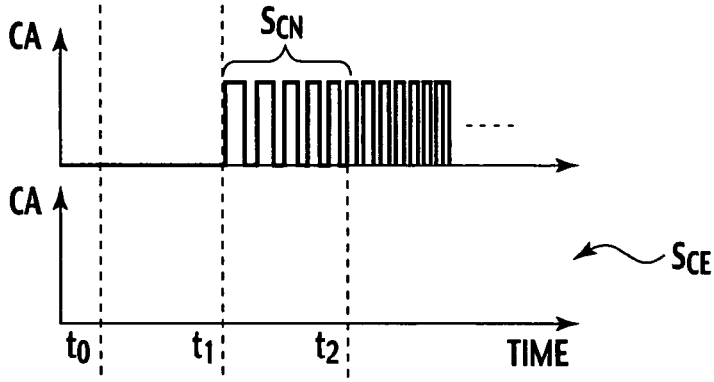
FIG. 6B shows time-dependent change in an output signal of a crank angle sensor when the engine is started.

Further, as a signal for detecting whether or not the engine 200 has shifted to a cranking state, the signal CA indicating the crank angle sensed by the crank angle sensor 141 is inputted into the engine status judgment unit 143. Immediately after the engine 200 has been normally started, the engine 200 enters the cranking state, and the crank angle sensor 141 outputs a low-frequency pulse signal SCN as shown in FIG. 6B. Accordingly, detecting this signal makes it possible to detect the fact that the engine 200 has entered the cranking state.

The alternator 142 is an electric generator driven by the rotation of the engine 200. The power generated by the alternator 142 is rectified by a rectifier element, such as a diode, and then charged in the battery 132.

Moreover, as a signal indicating the rotation/running status of the engine 200, the output voltage AV at the alternator 142 is inputted into the engine status judgment unit 143. When the engine 200 has been normally started, the alternator 142 is also rotated to output a voltage at or above a certain level. Accordingly, whether or not the engine 200 is appropriately running, i.e., the crankshaft thereof is rotating at a certain rotational frequency or more can be detected by observing the output voltage AV of the alternator 142.

The engine status judgment unit 143 detects the status of the engine 200 based on the outputs of the crank angle sensor 141 and the alternator 142, and outputs a signal EC indicating the detected status of the engine 200 to the microcomputer 126.

Based on the crank angle signal CA inputted from the crank angle sensor 141, the engine status judgment unit 143 detects whether or not the engine 200 has entered a cranking state. In the case where the engine status judgment unit 143 has detected that the engine 200 has entered the cranking state, the engine status judgment unit 143 outputs a signal ECN to that effect to the microcomputer 126 of the power distribution selector unit 123. When the output signal CA from the crank angle sensor 141 becomes a signal of low-frequency pulses like the signal SCN shown in FIG. 6B, the engine status judgment unit 143 judges that the engine 200 has entered the cranking state.

Moreover, based on the voltage value AV of the power generated in the alternator 142, which is outputted from the alternator 142, the engine status judgment unit 143 detects whether or not the engine 200 has entered a normal running state. In the case where the engine status judgment unit 143 has detected that the engine 200 is normally rotating, the engine status judgment unit 143 outputs a signal ERN to that effect to the microcomputer 126 of the power distribution selector unit 123. When the voltage value AV of the output voltage from the alternator 142 becomes equal to or greater than a predetermined threshold AV1 as shown in FIG. 6D (t2), the engine status judgment unit 143 judges that the engine 200 has entered a normal running state.

Figure 6C:
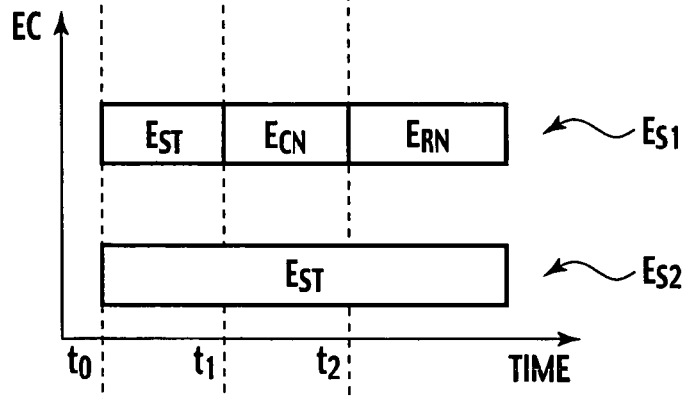
FIG. 6C shows time-dependent change in an output signal of an engine status judgment unit when the engine is started.
Figure 6D:
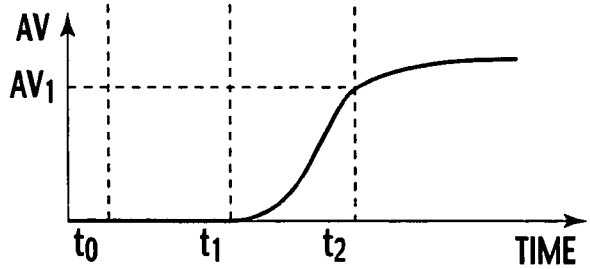
FIG. 6D shows time-dependent change in an output voltage of an alternator when the engine is started.

Accordingly, in the case where there is no failure in the starter 135 and the engine 200, the engine status judgment unit 143 generates a signal Es1 by which the status of the engine 200 changes from an engine-stopped state to a cranking state and an engine-running state sequentially as shown in FIG. 6C, and outputs this signal to the microcomputer 126 of the power distribution selector unit 123.

On the other hand, in the case where there is a failure in the starter 135, a signal Es2 by which the status of the engine 200 always remains in an engine-stopped state is outputted to the microcomputer 126 of the power distribution selector unit 123.

Next, the operation of the engine start control system 100 having the above-described configuration will be described with reference to FIGS. 4 and 5.

Figure 4:
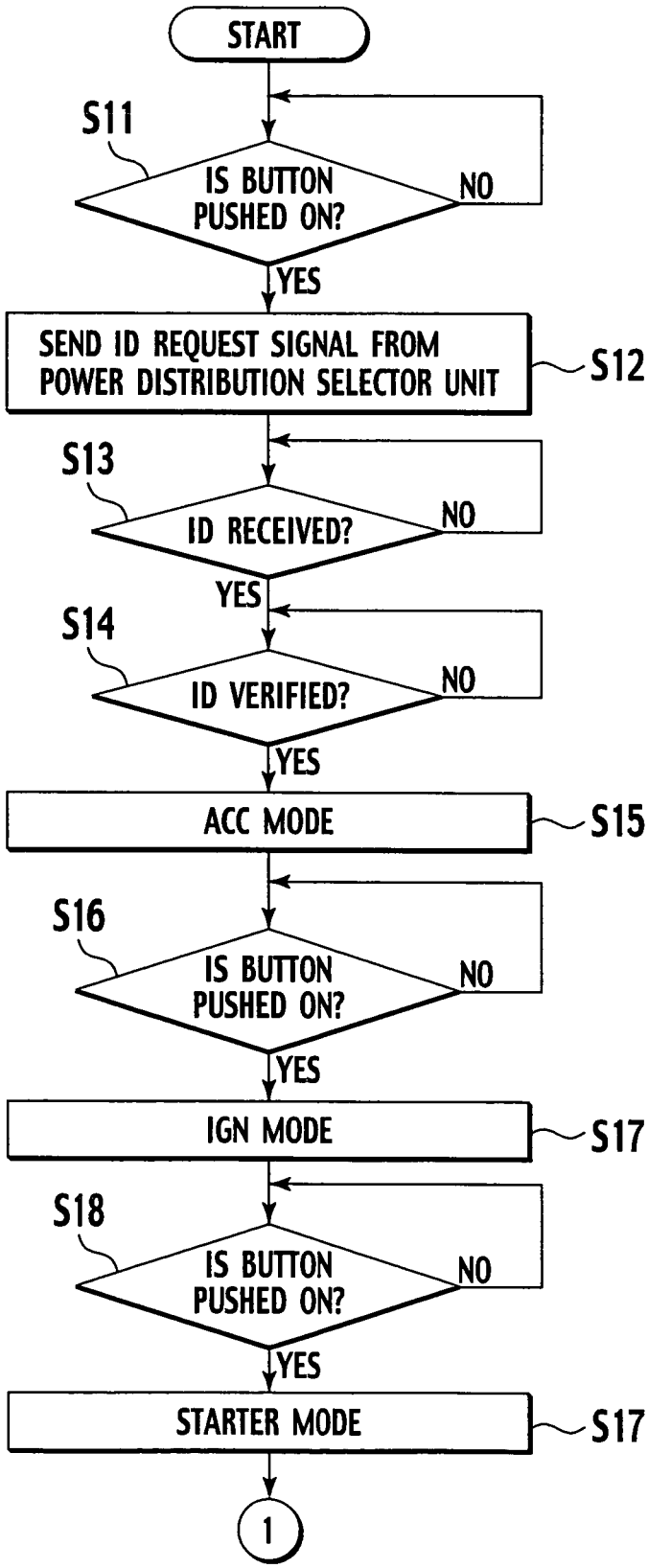
FIG. 4 is a first flowchart showing the flow of a process performed by the engine start control system shown in FIG. 1.
Figure 5:
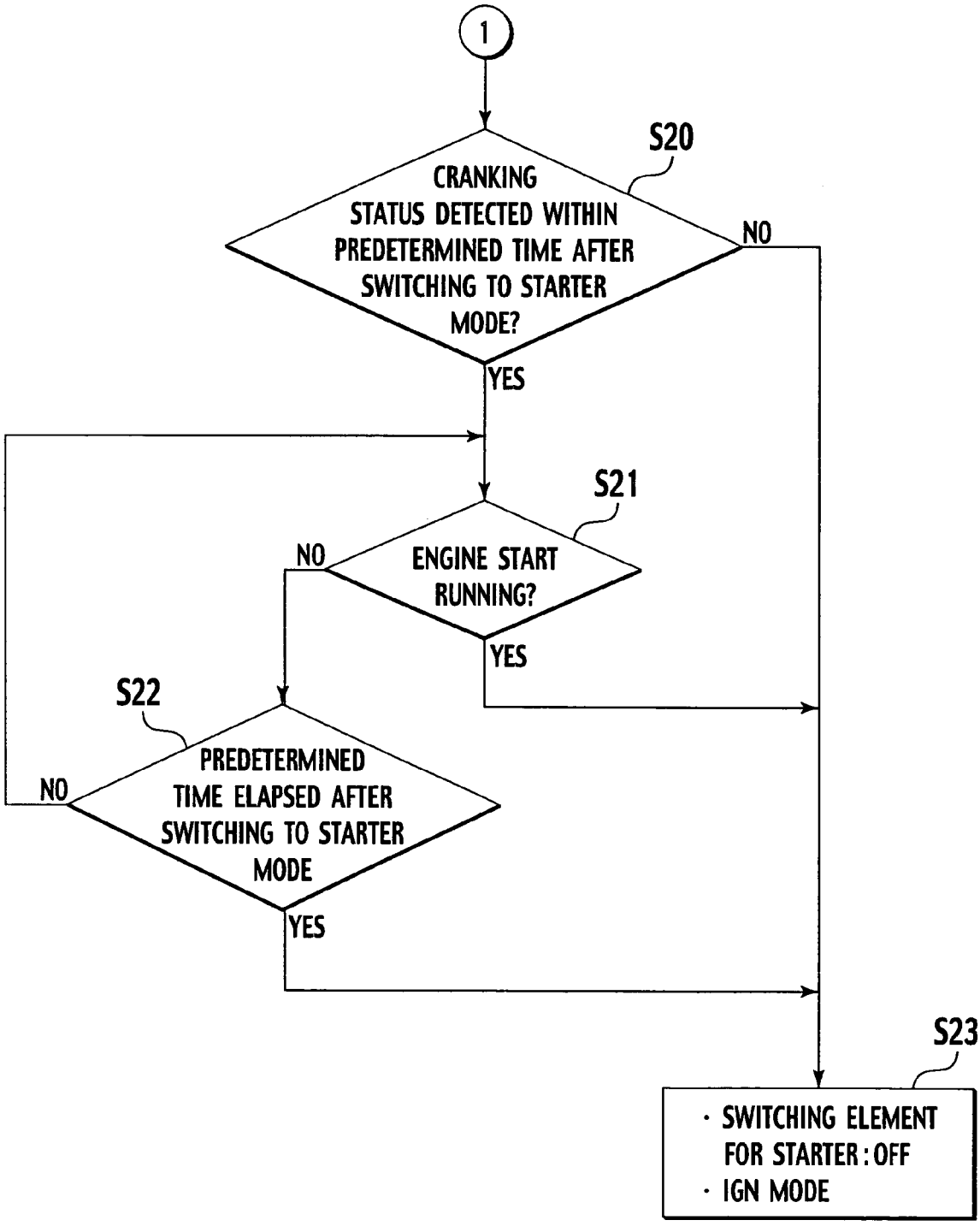
FIG. 5 is a second flowchart showing the flow of a process performed by the engine start control system shown in FIG. 1.

FIG. 4 is a flowchart showing the flow of a process performed by the engine start control system 100.

First, the driver as a user gets in the vehicle provided with the on-vehicle device 120 while holding the mobile device 110, and then pushes the push button 127. As a result, a signal to that effect is inputted from the push button 127 into the microcomputer 126 of the power distribution selector unit 123, and the microcomputer 126 detects this signal (step S11).

The microcomputer 126 requests ID information from the mobile device 110 in order to confirm that the mobile device 110 held by the driver is a mobile device registered in this vehicle. That is, the microcomputer 126 transmits an ID information request signal to the mobile device 110 through the transmitting circuit 124 and the transmitting antenna 121 (step S12).

The transmitted ID information request signal is received by the receiving antenna 111 of the mobile device 110, and inputted into the microcomputer 113 through the receiving circuit 112. The microcomputer 113 of the mobile device 110 transmits the ID information of the mobile device 110 to the on-vehicle device 120 through the transmitting circuit 114 and the transmitting antenna 115 in response to the ID request signal.

The microcomputer 126 of the on-vehicle device 120 is waiting for return data containing the ID information to be transmitted from the mobile device 110. A transmitted signal containing the ID information is received by the receiving antenna 122, and inputted into the microcomputer 126 through the receiving circuit 125 of the power distribution selector unit 123 (step S13).

The microcomputer 126 recognizes the inputted ID, and checks whether or not the inputted ID matches with the previously registered ID corresponding to this vehicle (step S14).

In the case where the inputted ID and the registered ID has matched with each other (step S14), the power distribution selector unit 123 outputs a control signal to the load switching unit 128 so as to connect the battery 132 and the ACC load 133, i.e., so as to switch the power distribution mode to ACC mode. As a result, the power from the battery 132 is supplied to the ACC load 133 (step S15).

When the push button 127 has been pushed again (step S16), the microcomputer 126 of the power distribution selector unit 123 outputs a control signal to the load switching unit 128 so as to connect the battery 132 to the ACC load 133 and the IGN load 134, i.e., so as to switch the power distribution mode to IGN mode. As a result, the power distribution mode is switched to IGN mode in the load switching unit 128, and the power from the battery 132 is supplied to the ACC load 133 and the IGN load 134 (step S17).

Next, when the push button 127 has been pushed (step S18), the power distribution selector unit 123 outputs a control signal to the load switching unit 128 so as to connect the battery 132 to the IGN load 134 and the starter 135 and disconnect the connection between the battery 132 and the ACC load 133, i.e., so as to switch the power distribution mode to STARTER mode. As a result, the supply of power from the battery 132 to the ACC load 133 is stopped, and the power from the battery 132 is supplied to the IGN load 134 and the starter 135 (step S19).

When the power distribution mode has been changed to STARTER mode, a current Is applied through the load switching unit 128 flows through the pull-in coil 137 and the holding coil 138 in the starter 135 connected to the battery 132. Since a current flows through the pull-in coil 137, the magnet switch 136 is energized to be changed to an ON state, and the battery 132 and the motor 139 of the starter 135 are therefore directly coupled. As a result, the motor 139 begins to rotate due to a large current directly supplied from the battery 132 to the motor 139.

Moreover, since a current flows through the pull-in coil 137, the pinion (not shown) is pushed out to the engine 200, and the pinion gear engages the ring gear provided around a flywheel or somewhere. Thus, the motor 139 and the engine 200 are mechanically coupled.

This allows the rotation of the motor 139 to be transferred to the engine 200 and the engine 200 to be started.

The engine 200 enters a cranking state immediately after the engine 200 has been started (FIG. 6B, t1). A cranking state is a state in which the rotational speed of the motor 139 is low immediately after the motor 139 has begun to rotate, as described above. In this state, a low-frequency pulse signal, such as the signal SCN shown in FIG. 6B, at a frequency within a predetermined range is outputted from the crank angle sensor 141, which senses the crank angle of the engine 200.

When the above-described output signal CA from the crank angle sensor 141 has been inputted into the engine status judgment unit 143, the engine status judgment unit 143 judges that a shift to a cranking state has been made, and outputs a signal to that effect to the microcomputer 126 (step S20).

Incidentally, after the magnet switch 136 has entered an ON state, the potentials at both ends of the pull-in coil 137 become the same, and the current flowing through the pull-in coil 137 becomes zero. Accordingly, the current Is applied to the starter 135 flows only through the holding coil 138. As a result, the current Is applied to the starter 135 at t0 decreases to a current value IN, which is smaller than a current value Imax before a shift to a cranking state has been made at t1, for example, as shown in FIG. 6A.

When the engine 200 has appropriately started and shifted from a cranking state to a normal running state, the output voltage AV of the alternator 142 also increases. Then, when the output voltage AV exceeds the previously set threshold AV1, the engine status judgment unit 143 judges that the engine 200 has begun to normally run, and outputs a signal ERN to that effect to the microcomputer 126 (step S21).

When the signal ERN indicating that the engine 200 has begun to run normally has been inputted, the microcomputer 126 of the power distribution selector unit 123 outputs a control signal to the load switching unit 128 so as to connect the battery 132 to the ACC load 133 and the IGN load 134 and disconnect the connection between the battery 132 and the starter 135, i.e., so as to switch the power distribution mode to IGN mode. As a result, the supply of power from the battery 132 to the starter 135 is stopped, and the power from the battery 132 is supplied to the ACC load 133 and the IGN load 134 (step S23).

With the above, the start of the engine 200 is completed.

On the other hand, for example, in the case where a contact failure has occurred in the magnet switch 136, the current supplied from the battery 132 continues to flow through the pull-in coil 137 and the holding coil 138 in the starter 135. Accordingly, the current is flowing through the starter 135 becomes larger than the current which flows through the starter 135 when a shift to a cranking period has been appropriately made as described above. Specifically, the current value Imax immediately after the supply of power to the pull-in coil 137 has been begun is maintained for a long time, like the current IE shown in FIG. 6A.

In such a situation, the low-frequency pulse signal SCN shown in FIG. 6B is not outputted from the crank angle sensor 141, and a no-signal state as also shown in FIG. 6B continues. The engine status judgment unit 143 detects that the above-described signal SCE continues, judges that the engine 200 has not entered a cranking state, and outputs a signal EST to that effect to the microcomputer 126 of the power distribution selector unit 123 (step S20).

In the case where the starter-switching element 131 of the load switching unit 128 has been changed to an ON state but the engine 200 does not enter a cranking state, the microcomputer 126 of the power distribution selector unit 123 judges that the starter 135 has a failure, and outputs a control signal to the load switching unit 128 so as to disconnect the connection between the battery 132 and the starter 135 and connect the battery 132 to the ACC load 133 and the IGN load 134, i.e., so as to switch the power distribution mode to IGN mode. As a result, the supply of power from the battery 132 to the starter 135 is stopped, and the power from the battery 132 is supplied to the ACC load 133 and the IGN load 134 (step S23).

Moreover, in the case where a shift to a cranking state has been made but a signal ERN indicating that the engine 200 has thereafter shifted to normal running is not obtained, i.e., in the case where the output voltage AV of the alternator 142 does not therefore exceed the predetermined threshold AV1, the microcomputer 126 detects this case based on the fact that the signal ERN, which is indicating that the engine 200 has begun to run normally, is not inputted from the engine status judgment unit 143 even when a predetermined time has elapsed (step S22). Then, the microcomputer 126 judges that there is an abnormality in the engine 200 or the starter 135, and outputs a control signal to the load switching unit 128 so as to disconnect the connection between the battery 132 and the starter 135 and connect the battery 132 to the ACC load 133 and the IGN load 134, i.e., so as to switch the power distribution mode to IGN mode. As a result, the supply of power from the battery 132 to the starter 135 is stopped, and the power from the battery 132 is supplied to the ACC load 133 and the IGN load 134 (step S23).

As described above, in the engine start control system 100 of the present embodiment, whether or not the engine 200 is in a cranking state is detected using an output signal CA of the crank angle sensor 141, and, in the case where the engine 200 does not enter the cranking state after a shift to STARTER mode has been made, the supply of power to the starter 135 is stopped by assuming that there is an abnormality in the starter 135. Accordingly, it is possible to prevent a situation where power continues to be supplied from the battery 132 to the starter 135 with the engine 200 not being started and where the power charged in the battery 132 is wasted.

Further, with regard to an electronic element for supplying power to the motor 139, a time for which a high voltage is applied or a large current flows can be limited. Accordingly, the rating of the element can be lowered, thus making it possible to reduce the cost of an engine start control system.

Moreover, since an element with smaller capacity can be used, the configuration can be simplified and the device can be miniaturized.

Furthermore, in the engine start control system 100, a shift of the engine 200 to a cranking state and the beginning of normal running thereof are judged based on the output CA of the crank angle sensor 141 and the output voltage AV of the alternator 142. Accordingly, a failure can be detected by detecting the rotation/running status of the engine 200 without an additional detection circuit.

Second Embodiment

Figure 8:
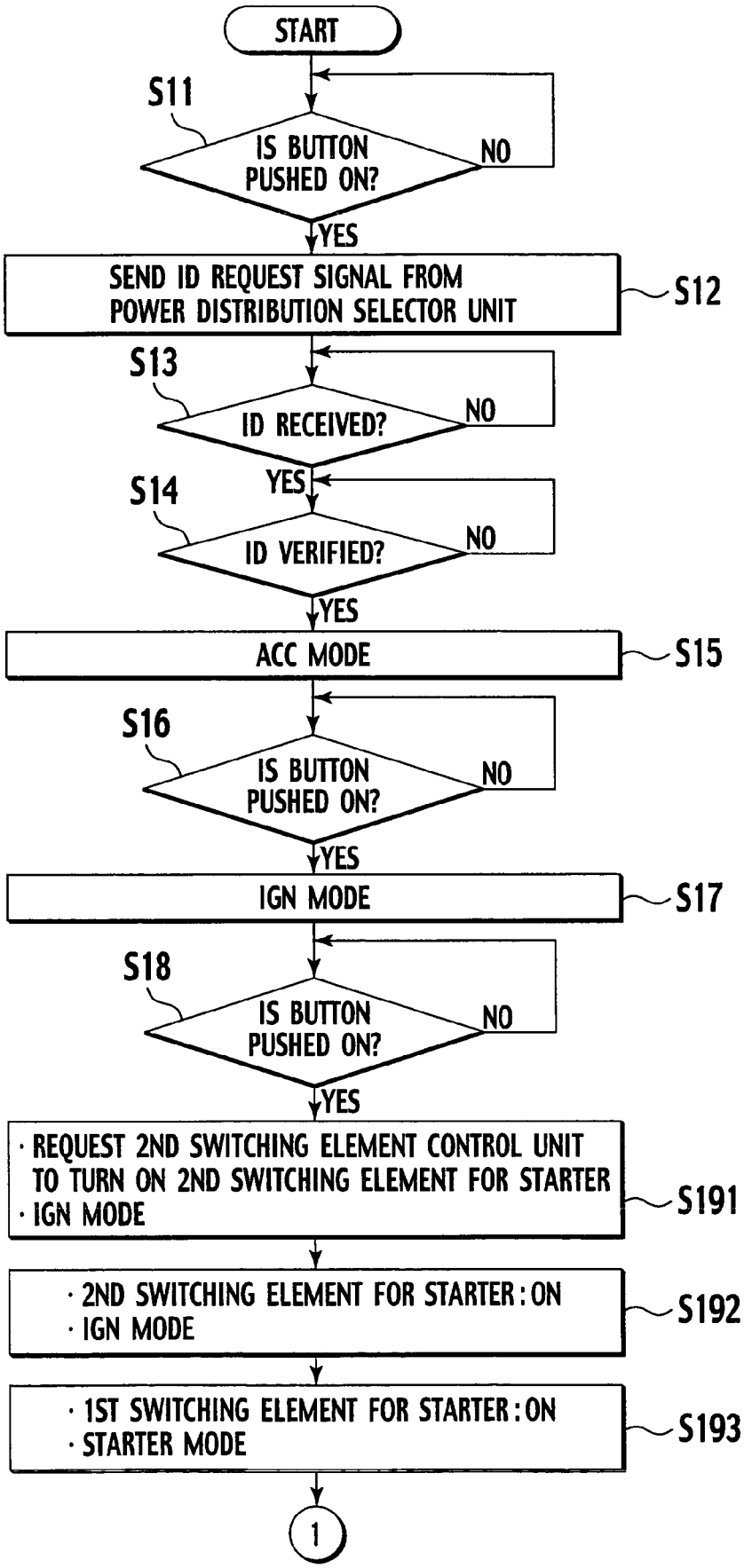
FIG. 8 is a first flowchart showing the flow of a process performed by the engine start control system shown in FIG. 7.
Figure 9:
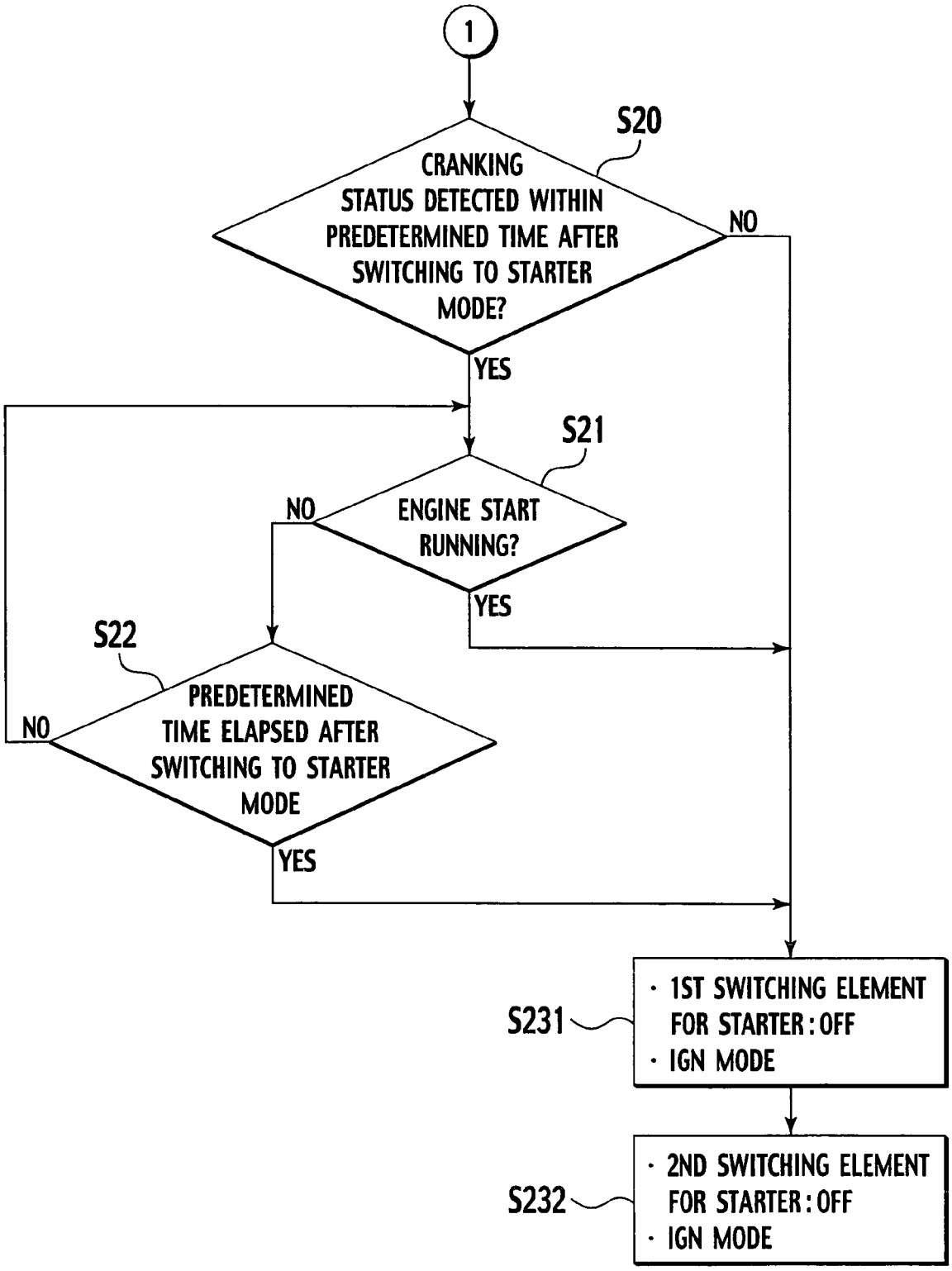
FIG. 9 is a second flowchart showing the flow of a process performed by the engine start control system shown in FIG. 7.

An engine start control system of a second embodiment of the present invention will be described with reference to FIGS. 7 to 9.

The engine start control system 100*b* of the second embodiment further includes a starter control unit 150 for turning on and off the supply of power from the battery 132 to the starter 135, which is provided between the load switching unit 128 and the starter 135, in addition to the components of the engine start control system 100 of the first embodiment as described above.

Because of the provision of the starter control unit 150, the operation of the microcomputer 126 of the power distribution selector unit 123 is slightly different from that of the first embodiment. However, except for this, the configuration of the engine start control system 100*b* is the same as that of the engine start control system 100 of the first embodiment as described above.

Hereinafter, differences with the first embodiment will be described.

Figure 7:
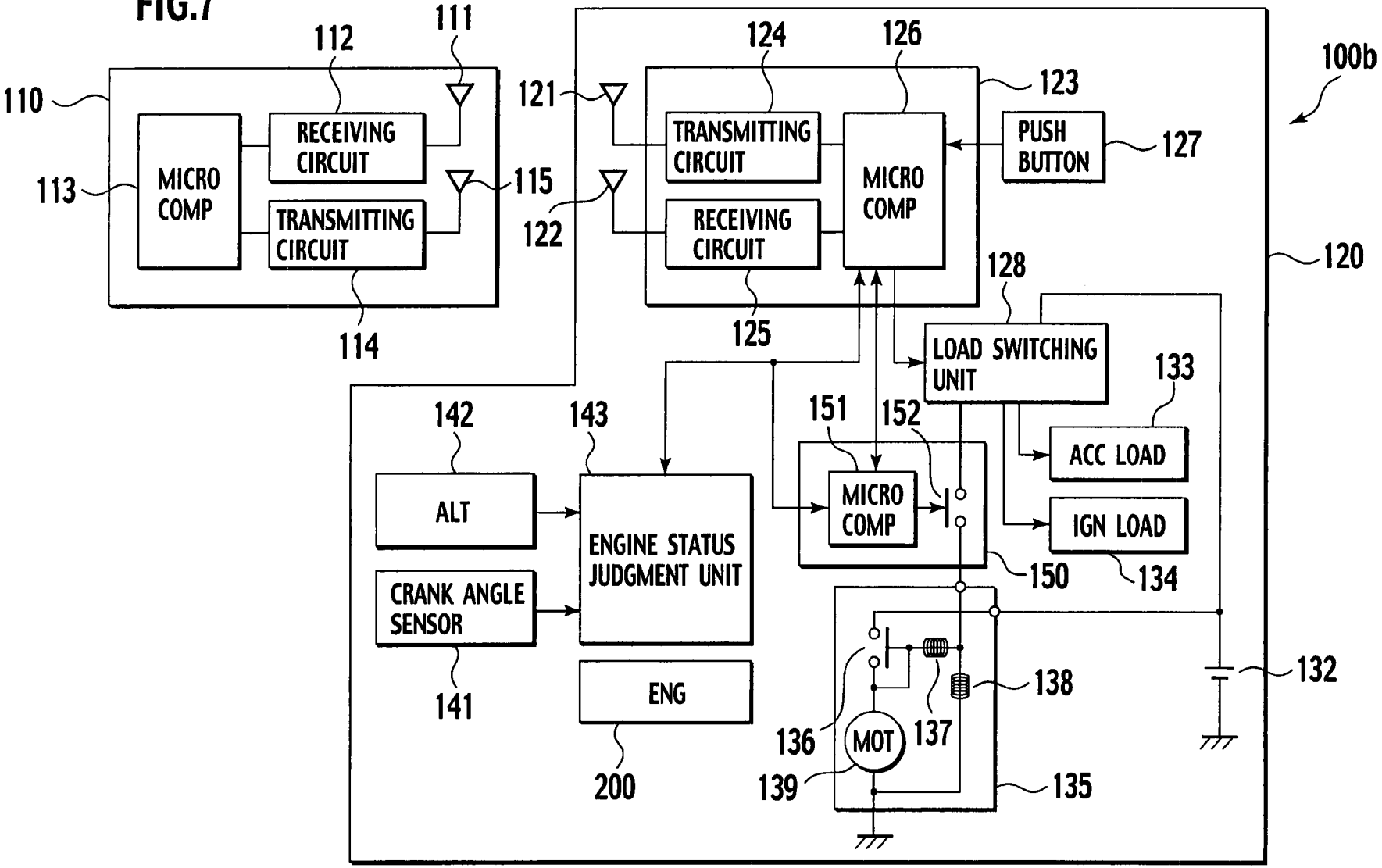
FIG. 7 is a block diagram showing the configuration of an engine start control system according to a second embodiment of the present invention.

In the engine start control system 100*b* shown in FIG. 7, the starter control unit 150 is provided between the load switching unit 128 and the starter 135.

The starter control unit 150 has a microcomputer 151 and a second starter-switching element 152.

The microcomputer 151 controls ON and OFF states of the second starter-switching element 152 based on a control signal from the microcomputer 126 of the power distribution selector unit 123 and a signal EC which indicates the status of the engine 200 and which is obtained from the engine status judgment unit 143.

The second starter-switching element 152 is a switching element for controlling ON and OFF states of a power supply line from the load switching unit 128 to the starter 135.

As described above with reference to FIG. 3, the starter-switching element 131 for controlling the power feeding to the starter 135 from the battery 132 has been provided inside the load switching unit 128. Accordingly, this starter-switching element 131 in the load switching unit 128 and the second starter-switching element 152 of the starter control unit 150 are provided in series in the power supply line, which connects the battery 132 and the starter 135. Accordingly, power is supplied from the battery 132 to the starter 135 only when both the starter-switching element 131 and the second starter-switching element 152 have entered ON states.

It is noted that, in the description below, the starter-switching element 131 provided inside the load switching unit 128 will be referred to as a first starter-switching element in response to the second starter-switching element 152 of the starter control unit 150.

A process of the above-described starter control unit 150 in the microcomputer 151 will be described in more detail.

First, when the power distribution mode has been IGN mode and then shifts to STARTER mode by pushing the push button 127, a control signal for instructing that the second starter-switching element 152 should be switched to an ON state is inputted from the microcomputer 126 of the power distribution selector unit 123 into the microcomputer 151. In accordance with this control signal, the microcomputer 151 switches the second starter-switching element 152 to an ON state. It is noted that, in the case where the second starter-switching element 152 has been switched to an ON state but the first starter-switching element of the load switching unit 128 is still in an OFF state, the power distribution mode is to be IGN mode.

Thereafter, the first starter-switching element of the load switching unit 128 is also changed to an ON state, and a shift to STARTER mode is made, thus beginning the power feeding to the starter 135.

After a shift to STARTER mode has been made and the start of the engine 200 has been begun, the microcomputer 151 of the starter control unit 150 independently controls the second starter-switching element 152 based on a signal EC which is inputted from the engine status judgment unit 143 and which indicates the status of the engine 200. That is, the microcomputer 151 switches the second starter-switching element 152 to an OFF state.

In the case where the engine 200 has been normally started, a signal ECN indicating that the engine 200 has entered a cranking state and a signal ERN indicating that the engine 200 has begun to run normally are sequentially inputted from the engine status judgment unit 143 into the microcomputer 151. When a predetermined time has elapsed after the signal ERN indicating that the engine 200 has begun to run normally has been inputted from the engine status judgment unit 143, the microcomputer 151 switches the second starter-switching element 152 to an OFF state.

This predetermined time is a time sufficient for the same signal from the engine status judgment unit 143 to be inputted into the microcomputer 126 of the power distribution selector unit 123, for the microcomputer 126 to output a switching signal to the load switching unit 128 so that the power distribution mode is changed from STARTER mode to IGN mode, and for the first starter-switching element 131 of the load switching unit 128 to be actually switched to an OFF state. That is, the microcomputer 151 waits for the predetermined time and then switches the second starter-switching element 152 so that the second starter-switching element 152 is disconnected after the first starter-switching element (starter-switching element 131 (FIG. 3)) of the load switching unit 128, which is provided in series with the second starter-switching element 152, has been disconnected.

Moreover, in the case where a signal ECN indicating that the engine 200 has entered a cranking state is not inputted from the engine status judgment unit 143 into the microcomputer 151, the microcomputer 151 waits for a predetermined time and then detects this situation (situation in which the engine 200 does not enter a cranking state). Then, the microcomputer 151 turns off the second starter-switching element 152 after a predetermined time has elapsed.

This predetermined time is a time sufficient for the microcomputer 126 of the power distribution selector unit 123 to similarly detect the situation in which the engine 200 does not enter a cranking state and output to the load switching unit 128 a control signal for shifting the power distribution mode to IGN mode by turning off the first starter-switching element and turning on the ACC-switching element 129, and for the switching elements in the load switching unit 128 to be actually switched.

Moreover, in the case where the engine 200 has entered a cranking state but a signal ERN indicating that the engine 200 has begun to run normally is not thereafter inputted, the microcomputer 151 waits for a predetermined time and then detects this situation (situation in which the engine 200 does not normally run). Then, the microcomputer 151 turns off the second starter-switching element 152 after a predetermined time has elapsed.

This predetermined time is a time sufficient for the microcomputer 126 of the power distribution selector unit 123 to similarly detect the situation in which the engine 200 does not enter a normal running state and output to the load switching unit 128 a control signal for shifting the power distribution mode to IGN mode by turning off the first starter-switching element and turning on the ACC-switching element 129, and for the switching elements in the load switching unit 128 to be actually switched.

Further, when the power distribution mode has changed to STARTER mode and a current Is is passed from the battery 132 to the starter 135, the microcomputer 126 of the power distribution selector unit 123 of the engine start control system 100*b* first outputs a control signal for turning on the second starter-switching element 152 to the microcomputer 151 of the starter control unit 150.

As a result, the microcomputer 151 controls the second starter-switching element 152 to change the second starter-switching element 152 to an ON state.

In addition, the microcomputer 126 of the power distribution selector unit 123 outputs a control signal to the load switching unit 128 so as to apply a current from the battery 132 to the starter 135, i.e., so as to turn on the first starter-switching element (starter-switching element 131 shown in FIG. 3) in the load switching unit 128.

As a result of performing such two-step switching, the battery 132 and the starter 135 are electrically connected, and power is supplied from the battery 132 to the starter 135.

The operations of the microcomputer 126 of the power distribution selector unit 123 and the starter control unit 150 in the engine start control system 100*b* having the above-described configuration when the engine 200 is started will be described in detail with reference to the flowcharts of FIGS. 8 and 9.

The process from step S11 to step S18 is the same as that in the engine start control system 100 of the first embodiment previously described with reference to FIGS. 4 and 5.

When the push button 127 has been pushed next in the state where the power distribution mode is in IGN mode (step S18), the power distribution selector unit 123 outputs to the microcomputer 151 of the starter control unit 150 a signal for requesting that the second starter-switching element 152 should be switched to an ON state (step S191).

In response to the request from the microcomputer 126, the microcomputer 151 of the starter control unit 150 changes the second starter-switching element 152 to an ON state (step S192). It is noted that the power distribution mode is still in IGN mode at this time.

Next, the microcomputer 126 of the power distribution selector unit 123 outputs a control signal to the load switching unit 128 so as to connect the battery 132 to the IGN load 134 and the starter 135 and disconnect the connection between the battery 132 and the ACC load 133. As a result, the supply of power from the battery 132 to the ACC load 133 is stopped, and the power from the battery 132 is supplied to the IGN load 134 and the starter 135 (step S193). Further, the power distribution mode shifts to STARTER mode at this time.

After a shift to STARTER mode has been made, similarly to the case of the engine start control system 100 of the first embodiment as described above, the pull-in coil 137 and the holding coil 138 of the starter 135 are energized, the magnet switch 136 is changed to an ON state, the battery 132 and the motor 139 of the starter 135 are directly coupled, and the motor 139 begins to rotate. Further, the motor 139 and the engine 200 are mechanically coupled, and the rotation of the motor 139 is transferred to the engine 200, whereby the engine 200 is started.

Moreover, along with the start of the engine 200, the detection (step S20 (FIG. 9)) of cranking based on an output signal CA from the crank angle sensor 141, and the judgment (step S21) that the engine 200 has shifted to normal running or the detection (step S22) of the fact that the engine 200 has not shifted to normal running based on an output voltage AV from the alternator 142 are also performed similarly to the case of the first embodiment as described above.

In the case where a shift to a cranking state has not been made (step S20), or in the case where the start of the engine 200 has confirmed (steps S21 and S22), the microcomputer 126 of the power distribution selector unit 123 first outputs a control signal to the load switching unit 128 so as to connect the battery 132 to the ACC load 133 and the IGN load 134 and disconnect the connection between the battery 132 and the starter 135, i.e., so as to switch the power distribution mode to IGN mode. As a result, the supply of power from the battery 132 to the starter 135 is stopped, and the power from the battery 132 is supplied to the ACC load 133 and the IGN load 134 (step S231).

These situations, i.e., the case where a shift to a cranking state has not been made (step S20) and the case where the start of the engine 200 has been confirmed (step S21 and S22), are detected by both the microcomputer 151 of the starter control unit 150 and the microcomputer 126 of the power distribution selector unit 123 similarly.

Accordingly, the microcomputer 151 waits for the switching elements in the load switching unit 128 to be switched by the operation of the microcomputer 126 of the power distribution selector unit 123 as described above and for the power distribution mode to be shifted to IGN mode, and then disconnects the second starter-switching element 152 (step S232).

With the above, a series of processes relating to the start of the engine 200 is completed.

In the engine start control system 100*b* of the second embodiment which has the above-described configuration and operation, two switching elements of the first starter-switching element (starter-switching element 131 (FIG. 3)) in the load switching unit 128 and the second starter-switching element 152 of the starter control unit 150, are provided between the battery 132 and the starter 135. Further, at least the switching of each switching element from an ON state to an OFF state is independently controlled by individual microcomputers of the microcomputer 126 of the power distribution selector unit 123 and the microcomputer 151 of the starter control unit 150.

Accordingly, even if the microcomputer 126 of the power distribution selector unit 123 runs away and the first starter-switching element of the load switching unit 128 cannot be switched to an OFF state, the microcomputer 151 of the starter control unit 150 can disconnect the connection between the battery 132 and the starter 135 by turning off the second starter-switching element 152. Meanwhile, on the contrary, even if the microcomputer 151 of the starter control unit 150 runs away and the second starter-switching element 152 cannot be switched to an OFF state, the microcomputer 126 of the power distribution selector unit 123 can disconnect the connection between the battery 132 and the starter 135 by turning off the first starter-switching element of the load switching unit 128.

Accordingly, even if a failure in an ON state occurs as a failure mode of an electronic element, the supply of power to the starter 135 can be stopped, thus making it possible to avoid the situation where the starter motor 139 is left being rotated.

Third Embodiment

An engine start control system of a third embodiment of the present invention will be described with reference to FIG. 10.

The engine start control system 100*c* of the third embodiment is designed to perform the transmission of signals among the engine status judgment unit 143, the starter control unit 150, and the power distribution selector unit 123 by use of a bus in the engine start control system 100*b* of the aforementioned second embodiment.

Figure 10:
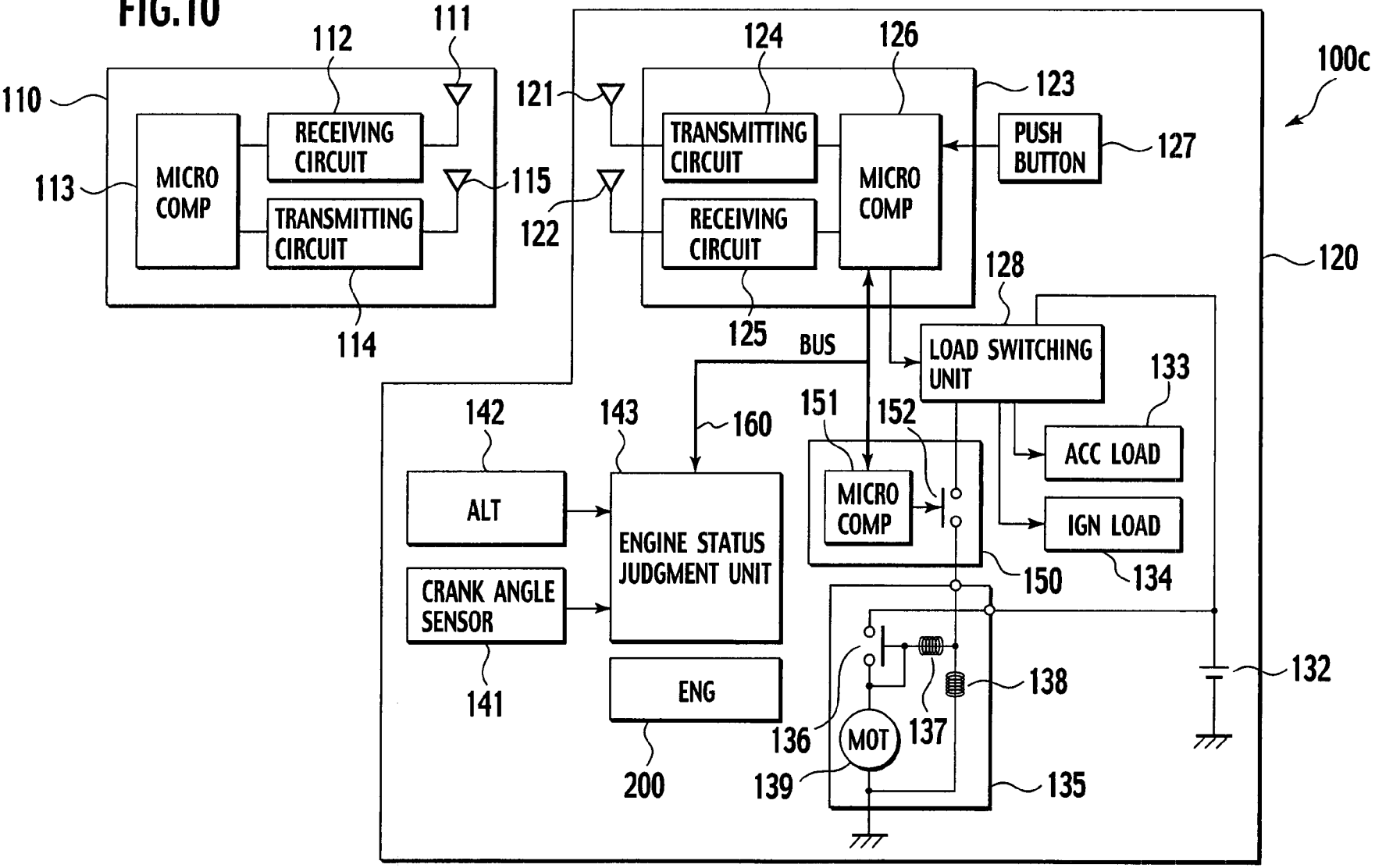
FIG. 10 is a block diagram showing the configuration of an engine start control system according to a third embodiment of the present invention.

The configuration of the above-described engine start control system 100*c* is shown in FIG. 10.

As shown in FIG. 10, in the engine start control system 100*c*, the engine status judgment unit 143, the microcomputer 151 of the starter control unit 150, and the microcomputer 126 of the power distribution selector unit 123 are connected by use of a bus 160. Further, the transmission of a control signal indicating that the second starter-switching element 152 is switched to an ON state from the microcomputer 126 of the power distribution selector unit 123 to the microcomputer 151 of the starter control unit 150 and the transmission of a signal EC indicating the status of the engine 200 from the engine status judgment unit 143 to the microcomputers 126 and 151, are performed via the bus 160.

It is noted that the data transmission system, control system, and the like of the bus 160 may be arbitrary systems.

The function and operation of each component of the engine start control system 100*c*, the function and operation of the entire engine start control system 100*c*, and the like are the same as those of the engine start control system 100*b* of the second embodiment as described above. Therefore the description will be omitted.

Configuring the engine start control system as described above allows the power distribution selector unit 123, the engine status judgment unit 143, and the starter control unit 150 to share information concerning respective detection results and control statuses. Accordingly, each of the units can more efficiently control the engine start control system 100*c* in cooperation with each other. Further, the number of interconnections can be reduced, thus making it possible to simplify the system configuration.

The preferred embodiments described herein are illustrative and not restrictive, and the invention may be practiced or embodied in other ways without departing from the spirit or essential character thereof. The scope of the invention being indicated by the claims, and all variations which come within the meaning of claims are intended to be embraced herein.

The present disclosure relates to subject matters contained in Japanese Patent Application No. 2003-425032, filed on Dec. 22, 2003, the disclosure of which is expressly incorporated herein by reference in its entirety.

What is claimed is:

1. An engine start control system comprising:

a switch for turning on/off power supply to a starter of an engine;

a crank angle sensor configured to output a pulse signal indicating a crank angle of the engine, wherein the pulse signal is used for controlling ignition timing of the engine;

an engine status judgment unit which determines whether or not the engine is in a cranking state based on the pulse signal input from the crank angle sensor; and a switch controller configured to control the switch to turn off the power supply to the starter, if a predetermined time elapses without the engine status judgment unit judging that the engine is in the cranking state, after the switch has been controlled to turn on the power supply to the starter.

2. The engine start control system according to claim 1, further comprising:

an alternator for performing power generation using rotation of the engine, wherein the engine status judgment unit judges that the engine is in a normal running state when an output voltage of the alternator becomes equal to or greater than a predetermined value, and wherein the switch controller controls the switch to turn off the power supply to the starter, if a predetermined time elapses without the engine status judgment unit judging that the engine is in the normal running state, after the engine has shifted to the cranking state.

3. The engine start control system according to claim 1, wherein a plurality of the switches are provided in series in a power line to the starter, and a plurality of the switch controllers independent of each other are provided to correspond to the plurality of switches.

4. The engine start control system according to claim 3, wherein the engine status judgment unit and the plurality of switch controllers are connected by a bus, and each of the plurality of the switch controllers independently controls the corresponding switch based on information concerning a status of the engine sent from the engine status judgment unit via the bus.

5. A method of controlling a start of an engine, comprising:

turning on power supply to a starter of the engine;

determining whether or not the engine is in a cranking state based on a pulse signal indicating a crank angle of the engine, wherein the cranking signal is used for controlling ignition timing of the engine; and turning off the power supply to the starter, if a predetermined time elapses without the engine being judged to be in the cranking state, after the power supply to the starter is turned on.

* * * * *